US012245699B1

(12) United States Patent
Schechner

(10) Patent No.: US 12,245,699 B1
(45) Date of Patent: Mar. 11, 2025

(54) SWING BED

(71) Applicant: E. Central Stores, Inc., Clearwater, FL (US)

(72) Inventor: Steven A. Schechner, St. Pete Beach, FL (US)

(73) Assignee: E. CENTRAL STORES, INC., Clearwater, FL (US)

( * ) Notice: Subject to any disclaimer, the term of this patent is extended or adjusted under 35 U.S.C. 154(b) by 0 days.

(21) Appl. No.: 18/502,114

(22) Filed: Nov. 6, 2023

(51) Int. Cl.
*A47C 21/00* (2006.01)

(52) U.S. Cl.
CPC ..... *A47C 21/006* (2013.01)

(58) Field of Classification Search
CPC ..... A47C 21/006
USPC ..... 5/131; 297/276
See application file for complete search history.

(56) References Cited

U.S. PATENT DOCUMENTS 275,899 A * 4/1883 Forster ..... A47D 13/105 297/487
289,267 A * 11/1883 Ingersoll ..... A47C 1/06 297/130
295,275 A * 3/1884 Oaks ..... A47C 3/0255 5/120
317,027 A * 5/1885 Shields ..... A47D 13/105 297/279
323,709 A * 8/1885 McMullen ..... A63G 9/16 472/124
872,736 A * 12/1907 Lansberry, Jr. ..... A47C 3/0255 297/411.44
911,426 A * 2/1909 Montague ..... A47D 13/105 297/487
979,236 A * 12/1910 Williams ..... B60N 2/22 297/354.12
1,066,991 A * 7/1913 Brogley ..... A47D 13/105 297/279
1,157,458 A * 10/1915 Thompson ..... A47D 11/005 297/9
1,201,305 A * 10/1916 Jones ..... A45F 3/22 5/129

(Continued)

OTHER PUBLICATIONS

"The Connie Swing Bed." Found online Dec. 7, 2023 at www.etsy.com. Product listed Nov. 1, 2023. Retrieved from URL: https://www.etsy.com/listing/1601099429/the-connie-swing-bed-twin-size-aluminum (Year: 2023).

*Primary Examiner* — Justin C Mikowski
*Assistant Examiner* — Luke Hall
(74) *Attorney, Agent, or Firm* — Larson & Larson; Frank Liebenow; Justin P. Miller

(57) ABSTRACT

A swing bed is made from extruded aluminum (e.g., aluminum tubes of rectangular cross-sectional shape) that are welded to each other to form a left side, right side, back side, and base. The left side, right side, and back side are attached to the base by screws that go through the base and into bosses that are press fit into the left side, right side, and back side. Tubes are inserted into each of the left side and right side going from the top to the bottom for passing of a chain or rope from which the swing bed is suspended. A hole is formed in the left side and right side, going through the tube, through which a pin is inserted through a link of the chain to hold the chain in the tube. In some embodiments, legs are provided to convert the swing bed into a stationary fixture.

16 Claims, 15 Drawing Sheets

(56) References Cited

U.S. PATENT DOCUMENTS 1,393,774 A * 10/1921 Gushman ..... A47C 3/0255 297/276
1,396,774 A * 11/1921 Neiswender ..... A47C 3/0255 297/117
1,414,318 A * 4/1922 Wrye ..... A47D 13/105 297/487
1,769,509 A * 7/1930 Hendrix ..... A47C 3/0255 297/363
1,773,752 A * 8/1930 Ross ..... A47C 3/0255 297/440.22
1,783,502 A * 12/1930 Fry ..... A47C 3/0255 472/124
1,825,457 A * 9/1931 Hoffman ..... A63G 9/16 472/120
2,048,110 A * 7/1936 Fry ..... A47D 13/105 472/120
2,200,881 A * 5/1940 Fry ..... A47C 3/0255 472/124
2,377,058 A * 5/1945 Watts ..... A47D 13/105 297/411.43
2,464,446 A * 3/1949 Helms ..... A47D 13/105 472/120
2,545,571 A * 3/1951 Charn ..... A63G 9/00 297/276
2,665,744 A * 1/1954 Hodgson ..... A47C 3/0255 297/271.6
4,704,750 A * 11/1987 Wheelock ..... A47C 21/006 5/120
D300,286 S 3/1989 Wheelock
D360,312 S * 7/1995 Lee ..... D6/335
5,902,187 A * 5/1999 Boring ..... A63G 9/02 297/77
6,237,889 B1 * 5/2001 Bischoff ..... B63B 39/005 180/902
D443,772 S 6/2001 Champion
6,343,838 B1 2/2002 Bagshaw
6,695,401 B1 * 2/2004 Noll ..... A47C 3/0255 297/440.15
7,815,255 B1 * 10/2010 Kiel ..... B60N 2/38 297/216.1
D681,354 S 5/2013 Hinterwirth
D697,324 S 1/2014 Arnold
D706,043 S 6/2014 Zhou et al.
D776,951 S 1/2017 Singleton et al.
D812,394 S 3/2018 Weng
D864,600 S 10/2019 Shen
D901,195 S 11/2020 Lee
2005/0189796 A1 * 9/2005 Gregorian ..... A47D 9/057 297/130
2015/0366359 A1 12/2015 Baldwin

* cited by examiner

SWING BED

BACKGROUND OF THE INVENTION

A swing bed is basically what the words say, a bed-like structure that is suspended from a ceiling or other support structure by ropes, cables, or chains. In the past, swing beds were made of wood. Although wood is a structurally solid material, wood is heavy adding to the cost and energy consumed in transportation and strain on workers and delivery personnel. Wood also has several design constraints that make it less desirable for use as a construction material for a swing bed. For one, wood is difficult to configure for home assembly and is heavy for a typical user to manipulate and carry. Additionally, wood is difficult to recycle once coated or painted.

Although wood is usually solid, to achieve the structural strength to support several people, a wooden swinge bed requires very hard wood of sufficient thickness, which is often very heavy—too heavy for the average person to move and manipulate. This weigh impacts the amount of energy used in transportation, both of raw materials to a manufacturing facility and transportation of the finished product to showrooms, then the end user. There are also secondary issues such as medical issues of delivery personnel and users from straining to carry such a heavy, large object.

As all products have a useful life, the end-of-life scenario of a swing bed must be considered. Wood is very difficult to recycle, especially when painted or coated. Painted wood is categorized as hazardous waste and is not recyclable in a wood recycling facility and, therefore, must be disposed of in a hazardous waste facility.

What is needed is a swing bed system that will be light in weight, easy to transport, easy to assemble, and be recyclable.

SUMMARY OF THE INVENTION

The swing bed is made from extruded aluminum (e.g., aluminum tubes, generally of rectangular cross-sectional shape) that are welded to each other to form a left side, right side, back side, and base. Each of the left side, right side, and back side are attached to the base by screws that go through the base and into bosses in the left side, right side, and back side. Tubes are inserted into each of the left side and right side going from the top to the bottom for passing of a chain or rope from which the swing bed is suspended. A hole is formed in the left side and right side, going through the tube, through which a pin is inserted through a link of the chain to hold the chain in the tube.

As the sides, base, and back are constructed and fastened together, it is fully anticipated that these components be mixed and matched to produce different sizes and styles of the swing bed. For example, two sides are attached to one base and back to form one size/style of swing bed and the same two sides are attached to another base and back to form another size/style of swing bed.

In some embodiments, legs are provided that are inserted into tubes of each arm of the swing bed to convert the swing bed into a stationary fixture.

In one embodiment, a swing bed kit is disclosed including a left side that has a first set of extruded aluminum sections welded together and a right side that has a second set of extruded aluminum sections welded together. A back side has a third set of extruded aluminum sections welded together and a base has a fourth set of extruded aluminum sections welded together. Threaded bosses are press fit into an inside surface of the left side and to an inside surface of the right side for attaching the left side to a first side of the base and affixing the right side to a second side of the base as well as press fit into an inside surface of the back side for attaching the back side to a back surface of the base and into the inside surface of the left side and the inside surface of the right side for attaching the left side to a left surface of the back side and attaching the right side to a right surface of the back side. Holes in the base are located to mate with each of the threaded bosses.

In another embodiment, a swing bed is disclosed including a left side that has a first set of extruded aluminum sections welded together and has a first tube and a second tube passing through an upper surface of the left side, through the left side, and out of a lower surface of the left side. A right side has a second set of extruded aluminum sections welded together and has a third tube and a fourth tube passing through an upper surface of the right side, through the right side, and out of a lower surface of the right side. A back side has a third set of extruded aluminum sections welded together and a base has a fourth set of extruded aluminum sections welded together. Threaded bosses are press fit into an inside surface of the left side and an inside surface of the right side for attaching the left side to a first side of the base and attaching the right side to an opposite side of the base. Threaded bosses are also press fit into an inside surface of the back side for attaching the back side to a back surface of the base and into the inside surface of the left side and the inside surface of the right side for attaching the left side to a left surface of the back side and attaching the right side to a right surface of the back side. Holes are drilled/formed in the base located to mate with each of the threaded bosses and holes are drilled/formed in the back side located to mate with the threaded bosses. Screws are passed through the holes and into a respective boss and tightened to hold the left side, right side, and back side to the base.

In another embodiment, a method of making a swing bed is disclosed including fabricating a left side by welding a first set of extruded aluminum sections together and inserting a first tube through a first top hole in an upper surface of the left side, through the left side, and out of a first lower hole in a lower surface of the left side and inserting a second tube through a second top hole in the upper surface of the left side, through the left side, and out of a second lower hole in the lower surface of the left side. Fabricating a right side by welding a second set of extruded aluminum sections together and inserting a third tube through a third top hole in an upper surface of the right side, through the right side, and out of a third lower hole in a lower surface of the right side and inserting a fourth tube through a fourth top hole in the upper surface of the right side, through the right side, and out of a fourth lower hole in the lower surface of the right side. Fabricating a back side by welding a third set of extruded aluminum sections together and fabricating a base by welding a fourth set of extruded aluminum together. Forming and/or drilling a first set of holes in an inside surface of the left side and in an inside surface of the right side and press fitting threaded bosses into each of the first set of holes. Forming and/or drilling a second set of holes in an insides surface of the back side and press fitting threaded bosses into each of the second set of holes, forming and/or drilling a third set of holes in an insides surface of the back side and forming holes in the base located to mate with each of the threaded bosses. Now, passing each of a plurality of screws through each of the holes and into a respective boss for holding the left side to the base, the right side to the base, the back side to the base, the left side to the back side, and the right side to the back side.

BRIEF DESCRIPTION OF DRAWINGS

The invention can be best understood by those having ordinary skill in the art by reference to the following detailed description when considered in conjunction with the accompanying drawings in which.

DETAILED DESCRIPTION OF THE INVENTION

Figure 1:
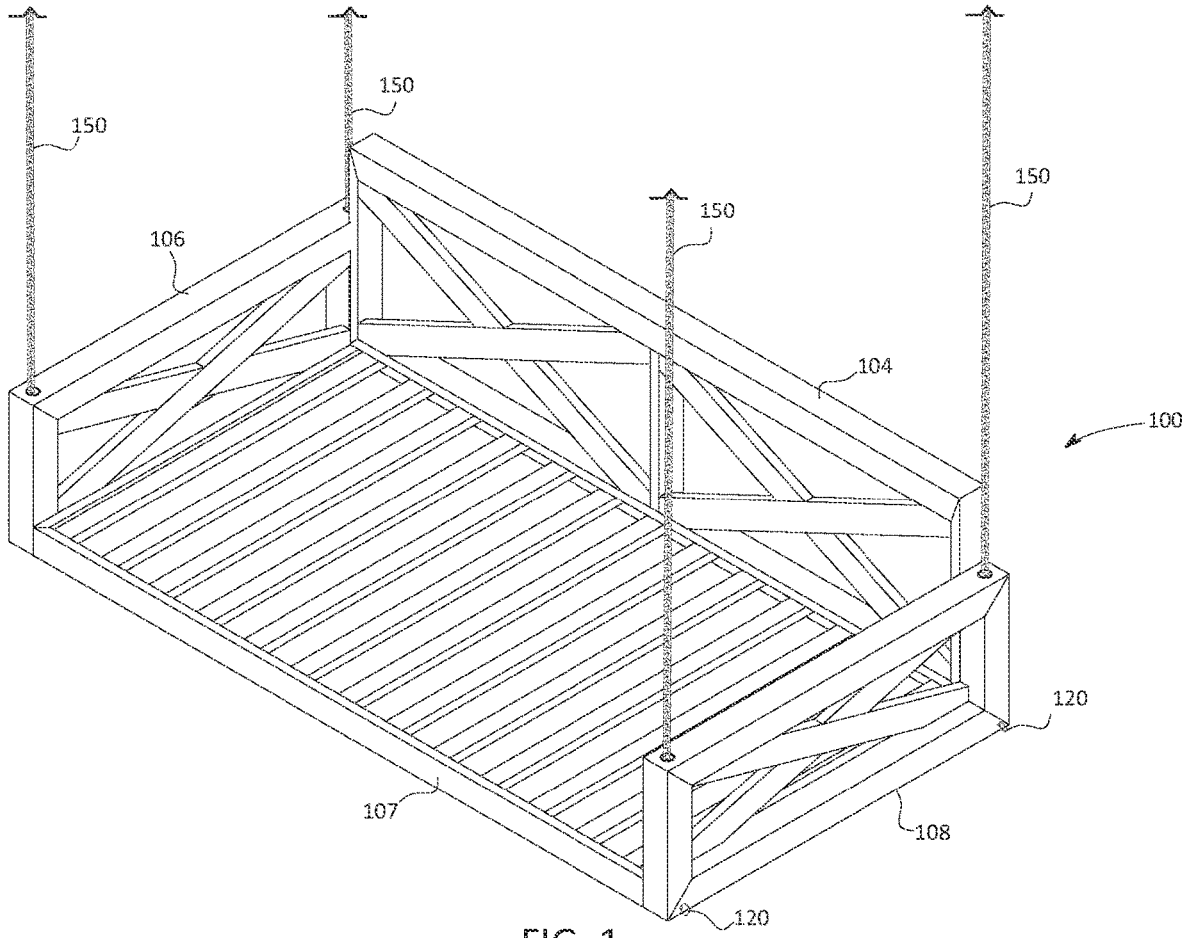
FIG. 1 illustrates a perspective view of a swing bed.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a swing bed 100 is shown. In this view, the swing bed 100 is suspended from a structure by suspension members such as chains 150 or ropes 150*a* (see FIG. 15). The swing bed 100 has a base 107, a left side 106, a right side 108, and a back side 104. As will be shown in detail, when chains 150 are utilized, the chains 150 are locked to the swing bed 100 by pins 120.

The swing bed 100 is fabricated from extruded aluminum (e.g., hollow pieces of aluminum) that are cut and welded into the shape of the base 107, the left side 106, the right side 108, and the back side 104. Such construction provides for a quality coat of paint (e.g., powder coated) and, after the end-of-life of the swing bed 100, the entire swing bed 100 is readily recycled anywhere aluminum is recycled.

Further, by making the swing bed 100 from extruded aluminum, the overall weight of the swing bed 100 is reduced to less than that of an equivalent wooden swing bed. Therefore, the shipping weight of the finished swing bed 100 is reduced as well as the shipping weight of raw materials to the factory. This lower weight not only saves energy and shipping cost, but reduces strain on transportation personnel, installers, and the end user when the end user completes the installation.

Figure 2:
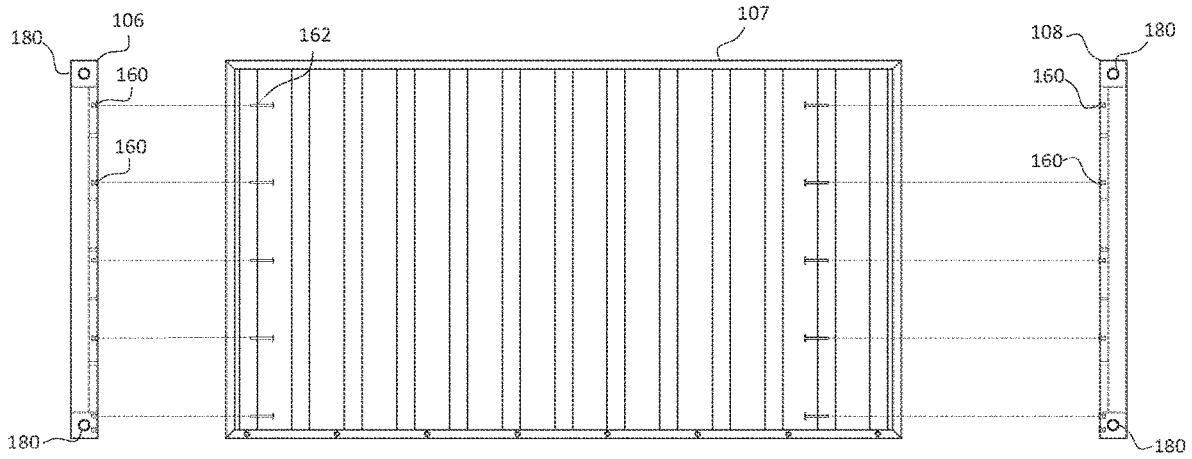
FIG. 2 illustrates a plan view of the swing bed during assembly.
Figure 3:
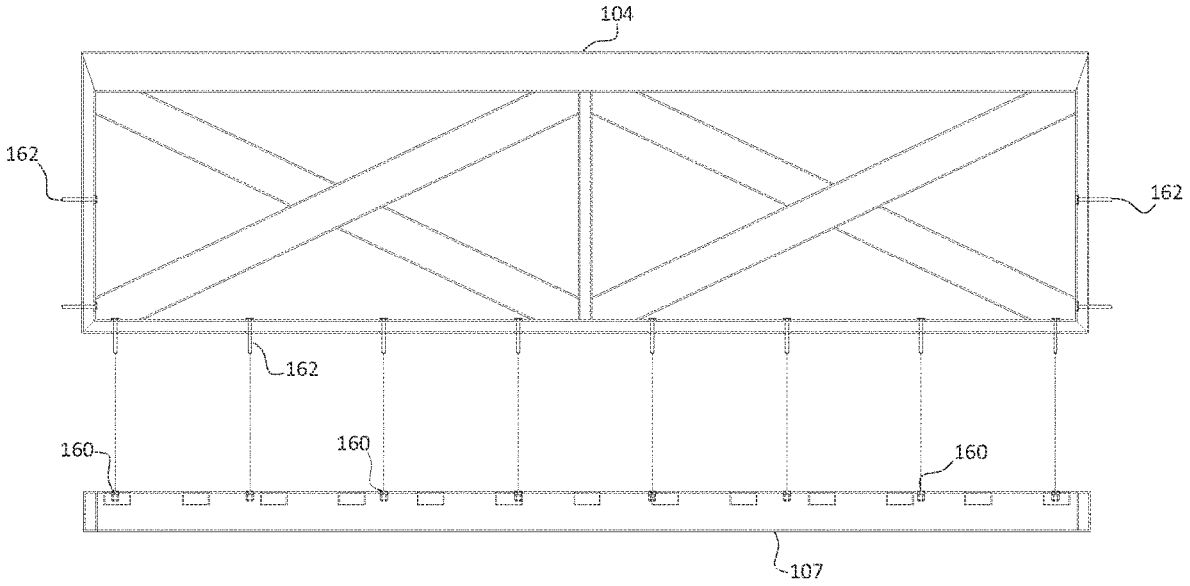
FIG. 3 illustrates an elevational view of the swing bed during assembly.

Further, by shipping the swing bed in four sections (the base 107, the left side 106, the right side 108, and the back side 104) and assembling at the point of use, each shipping package is of a weight that is easily handled by shipping staff and the end-user who will assemble the four sections (the base 107, the left side 106, the right side 108, and the back side 104) as will be shown with FIGS. 2 and 3.

Referring to FIG. 2 and FIG. 3, views of the swing bed 100 are shown during assembly. Although any method of affixing the left side 106, the right side 108, and the back side 104 to the base 107 are anticipated, in the example shown, several threaded bosses 160 are press-fit into an inside surface of the left side 106, the right side 108, and the back side 104 and screws 162 pass through holes formed/drilled in the outer sides and back of the base 107 and the screws are threaded into the threaded bosses 160 and tightened. As the inside surface of the left side 106, the right side 108, and the back side 104 face inwardly towards the base 107, the heads of the screws 162 are not visible unless the swing bed 100 is viewed from the bottom, which is unlikely.

In FIG. 3, there are also bosses on inside surfaces of the left side 106 and the right side 108 and screws 162 passing through holes in the sides of the back side 104. These screws will be visible during use of the swing bed 100.

Visible on the bottom of the left side 106 and the right side 108 in FIG. 2 are ends of tubes 180 that pass through the left side 106 and the right side 108. The tubes 180 provide for ease of insertion of a chain 150 or rope through the left side 106 and the right side 108 for supporting the swing bed 100, as will be shown.

Figure 4:
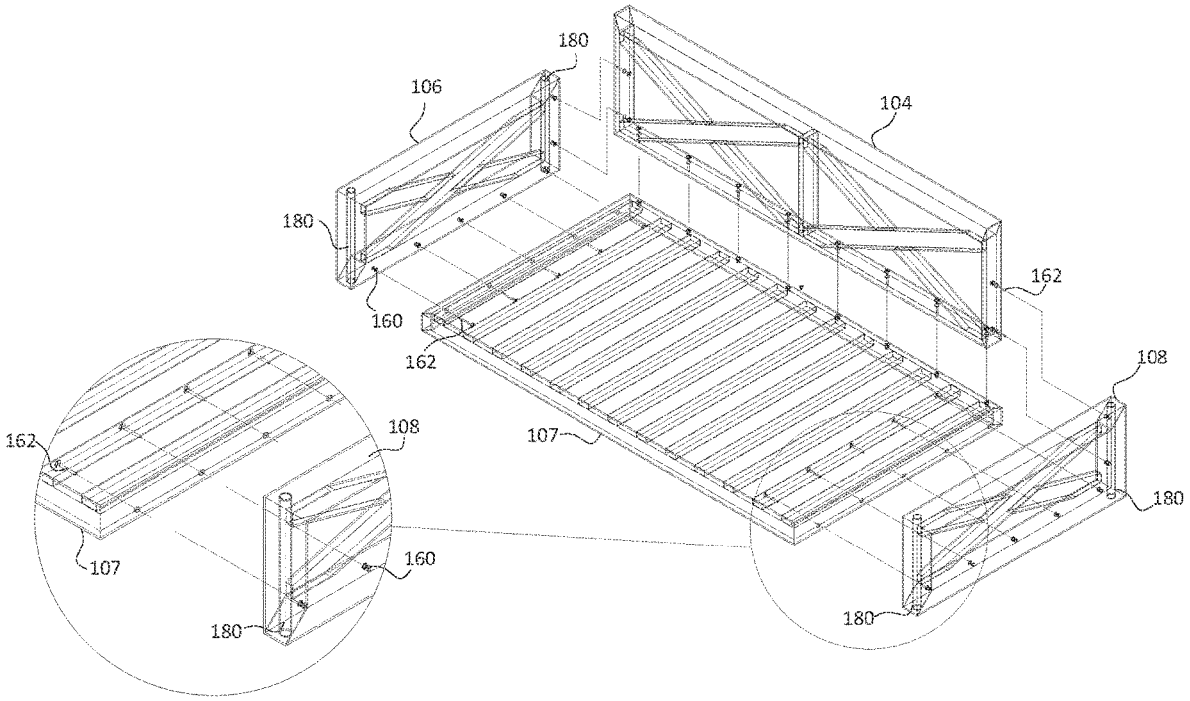
FIG. 4 illustrates an exploded view of the swing bed during assembly.

Referring to FIG. 4, an exploded view of the swing bed 100 during assembly is shown. Again, in the example shown, several threaded bosses 160 are press-fit into an inner surface of the left side 106, the right side 108, and the back side 104 and screws 162 pass through holes formed/drilled in the outer sides and back of the base 107. The screws are threaded into the threaded bosses 160 and tightened to hold he left side 106, the right side 108, and the back side 104 securely to the base 107. As the holes are through the sides of the base 107, the heads of the screws 162 are not visible unless the swing bed 100 is viewed from the bottom, which is unlikely.

There are also bosses on inside surfaces of the left side 106 and right side 108 and screws 162 passing through holes in the sides of the back side 104. These screws will be visible during use of the swing bed 100.

Visible on the bottom of the left side 106 and right side 108 are ends of tubes 180 that pass through the left side 106 and right side 108. The tubes 180 provide for ease of insertion of a chains 150 or ropes 150*a* for supporting the swing bed 100, as will be shown.

Figure 5:
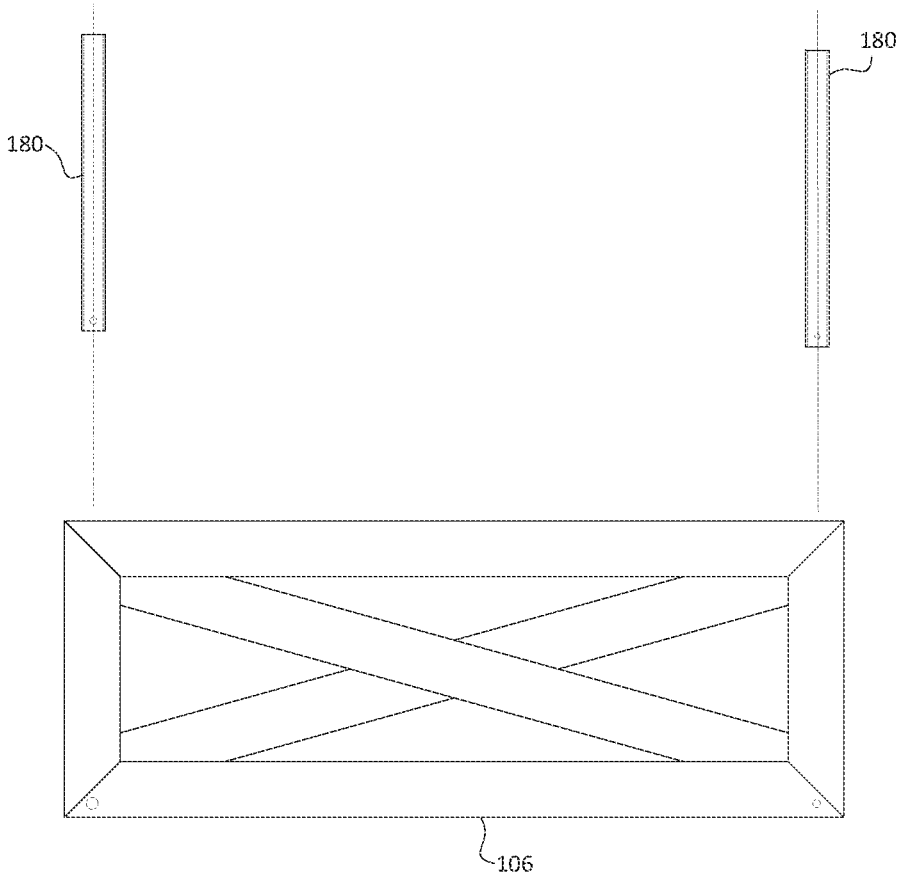
FIG. 5 illustrates an elevational view of one side of the swing bed.
Figure 6:
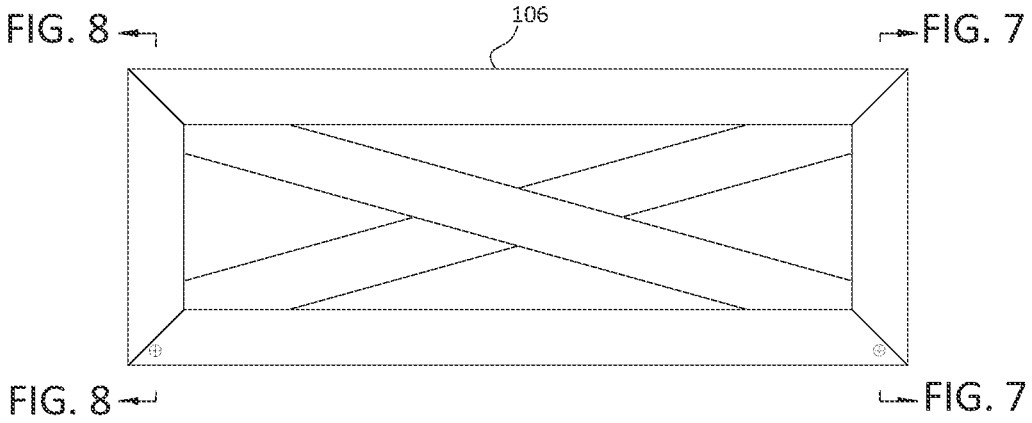
FIG. 6 illustrates an elevational view of one side of the swing bed.

Referring to FIG. 5 and FIG. 6, elevational views of the left side 106 of the swing bed 100 are shown. In FIG. 5, tubes 180 are shown above the left side 106, ready to be inserted into holes formed in the left side 106. Note that the right side 108 has a similar set of tubes 180 installed in the same way, but not shown for brevity and clarity reasons.

After insertion, the tube 180 is held in place by any way known in the industry, including, but not limited to, press fitting, welding, and using an adhesive. The reason for the tubes 180 is to improve ease of assembly as, without the tubes, it would be difficult to feed the chain 150 or rope (not shown for brevity and clarity reasons) through the left side 106 (or right side 108) and secure such properly. In FIG. 6, the tubes 180 are installed in the left side 106 and are not visible from in this elevational view.

Figure 7:
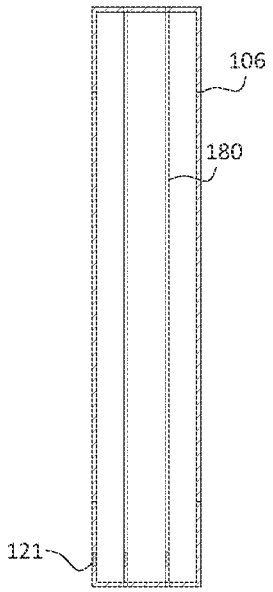
FIG. 7 illustrates a sectional view of the side of the swing bed cut along lines 7-7 of FIG. 6.
Figure 8:
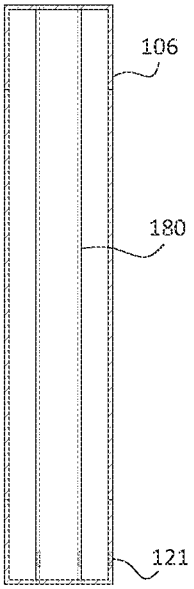
FIG. 8 illustrates a sectional view of the side of the swing bed cut along lines 8-8 of FIG. 6.

Referring to FIG. 7 and FIG. 8, sectional views of the left side 106 of the swing bed 100 are shown, FIG. 7 being cut along lines 7-7 of FIG. 6 and FIG. 8 being cut along lines 8-8 of FIG. 6. There are two tubes 180 that have been inserted into each post of the left side 106 which are visible in this cut view running from a top surface of the left side 106 to a bottom surface of the left side 106.

Figure 7A:
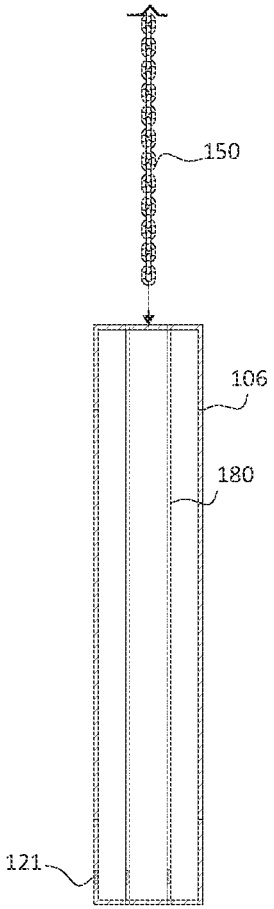
FIG. 7A illustrates a sectional view of the side of the swing bed cut along lines 7-7 of FIG. 6 with chain ready for installation.
Figure 8A:
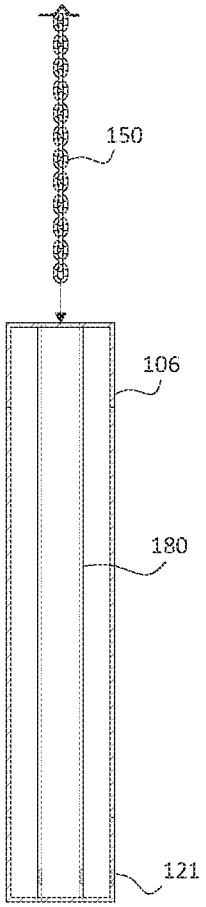
FIG. 8A illustrates a sectional view of the side of the swing bed cut along lines 8-8 of FIG. 6 with chain ready for installation.

Referring to FIG. 7A and FIG. 8A, sectional views of the left side 106 of the swing bed 100 are shown, FIG. 7A being cut along lines 7-7 of FIG. 6 and FIG. 8A being cut along lines 8-8 of FIG. 6. Chains 150 are shown ready to be dropped into the tubes 180. A hole 121 in a surface of each post of the left side 106 and similarly located holes in the tubes 180 are for insertion of a retaining pin 120 as will be shown.

Figure 7B:
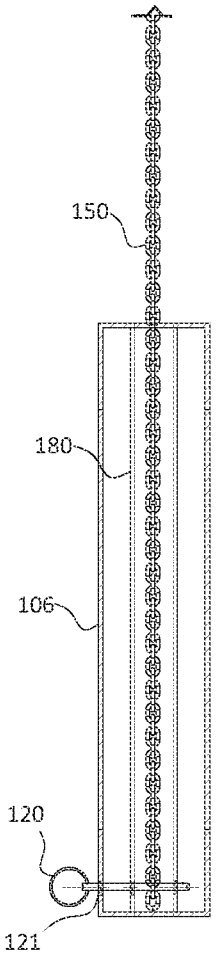
FIG. 7B illustrates a sectional view of the side of the swing bed cut along lines 7-7 of FIG. 6 with chain installed.
Figure 8B:
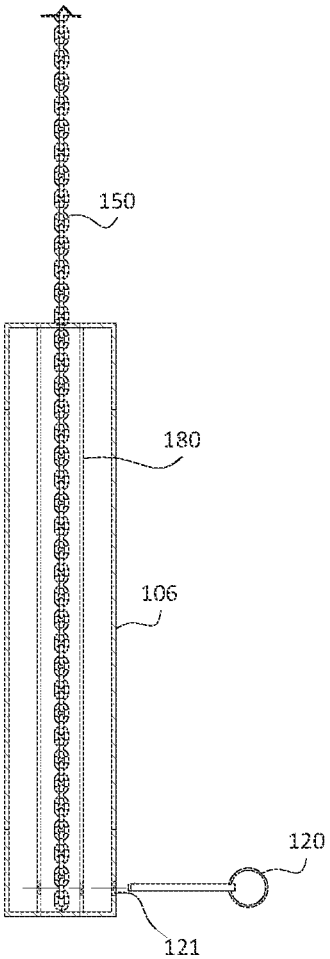
FIG. 8B illustrates a sectional view of the side of the swing bed cut along lines 8-8 of FIG. 6 with chain installed.

Referring to FIG. 7B and FIG. 8B, sectional views of the left side 106 of the swing bed 100 are shown, FIG. 7B being cut along lines 7-7 of FIG. 6 and FIG. 8B being cut along lines 8-8 of FIG. 6. In this view, the chains 150 have been fed down the tubes 180. In FIG. 7B, a pin 120 (or any elongated device that will pass through the hole 121 in the side surface of one post of the left side 106 and through a link of the chain 150) is inserted into the hole 121, passing through a link of the chain 150. The pin 120 will be held by friction as the weight of the swing bed 100 is supported by the chains 150 or by any other way known in the industry such as threads, snaps, springs, etc. Another pin 120 is shown ready to be inserted into the hole 121 of the other post of the left side 106 and through a link of the chain 150 in FIG. 8B.

Figure 9:
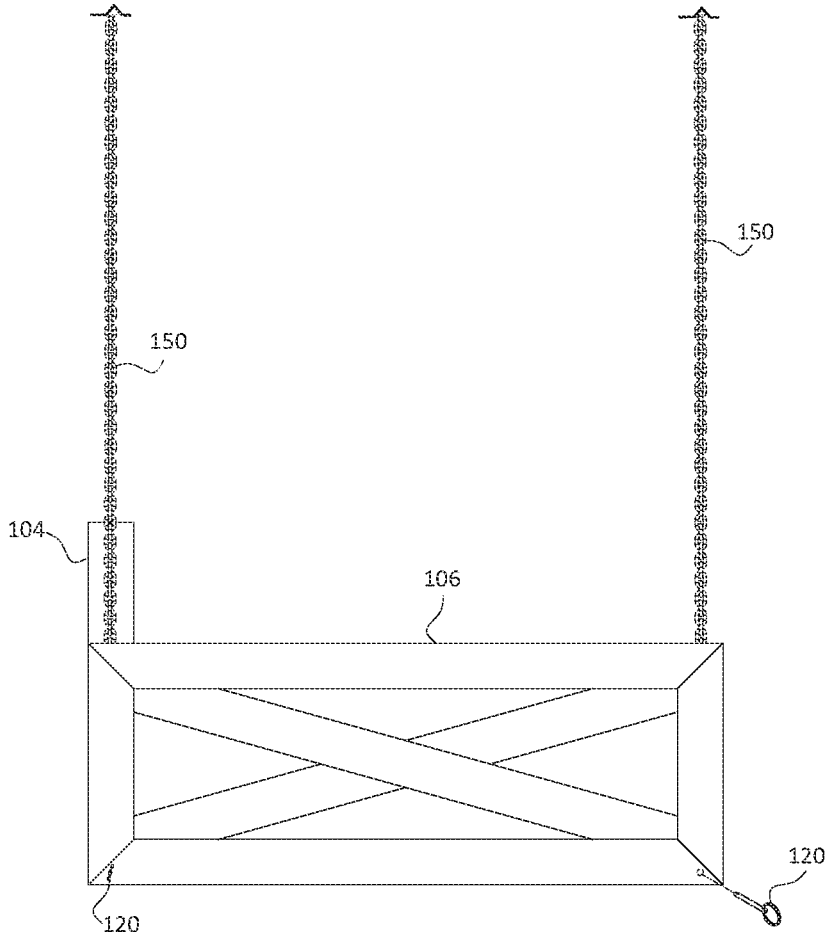
FIG. 9 illustrates an elevational view of the side of the swing bed with chain installed.

Referring to FIG. 9, an elevational view of the side of the swing bed 100 is shown with a chain 150 installed, again, the pin 120 to the right is just being inserted through the hole 121 and a link of the chain 150 as described above. In this view, a portion of the back side 104 is also visible.

Referring to FIGS. 10 through 14, views of the swing bed 100 are shown with optional legs 400. For various reasons, there are times when it is advantageous for the swing bed 100 to have legs 400. For one reason, the legs 400 will assist installation of the swing bed 100 by a single person, holding the swing bed 100 in position above the floor while installing the chains 150 (or other support medium such as ropes 150*a* or cables). Another reason is when the user desires a floor-mounted bed (e.g., without chains 150, ropes 150*a* or cables). In this way, a manufacturer, distributor, showroom, store can stock a single swing bed 100 with optional legs 400 and have the ability to sell the swing bed 100 with chains 150 (or other support medium such as ropes 150*a* or cables) for hanging from a structure or with the optional legs 400 for free standing on a floor or other surface.

Figure 10:
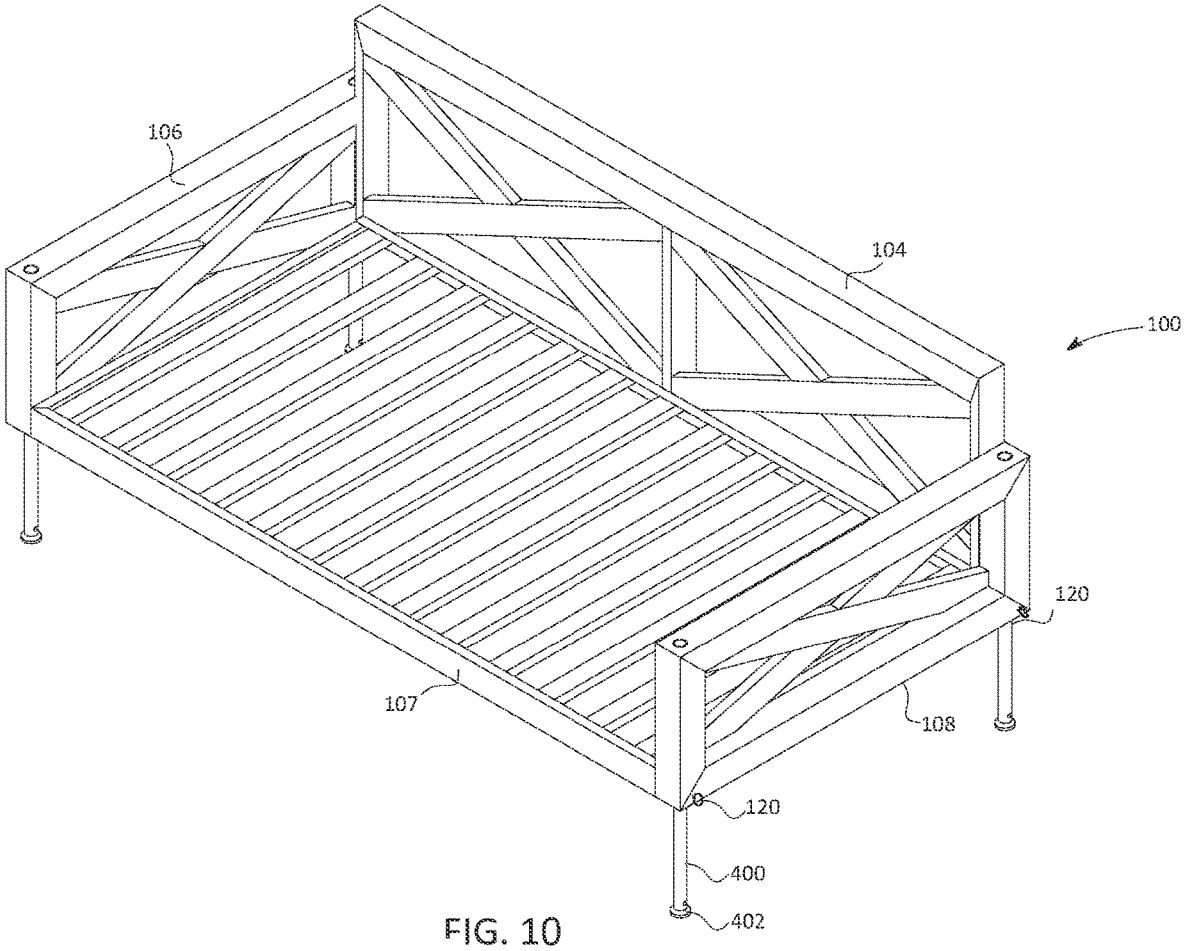
FIG. 10 illustrates a perspective view of a swing bed with optional legs.

In FIG. 10, the legs 400 (with feet 402) are extended and held in place by the pins 120 (e.g., the same pins 120 that were used to lock the chain 150 in place). This creates a free-standing swing bed 100 that is stationary on a surface such as a floor. As such, the swing bed 100 is usable in this configuration for sitting, etc., and one could also feed a chain into one of the tubes 180 while removing the pin 120 associated with that leg 400, the re-inserting the pin 120 to lock the chain 150 in place, repeating for each leg 400/chain 150.

Figure 11:
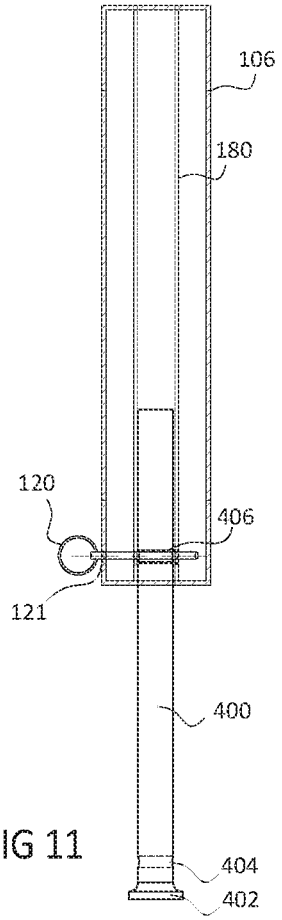
FIG. 11 illustrates a side cut-away view of a swing bed with one of the optional legs extended.
Figure 14:
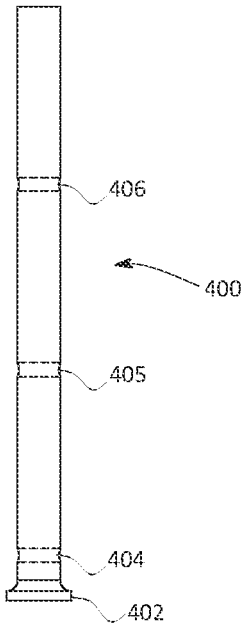
FIG. 14 illustrates an elevation view of one optional leg.

In FIG. 11, it is shown how the pin 120 passes through the hole 121 of the leg and through the leg 400, thereby locking the leg 400 in an extended position. As shown in FIG. 14, it is anticipated that there are multiple holes 404/405/406 passing through each leg 400 to lock the leg 400 in a full extended position (hole 406) and an intermediate position (hole 405) where the leg 400 is between the retracted position and the fully extended position.

Figure 12:
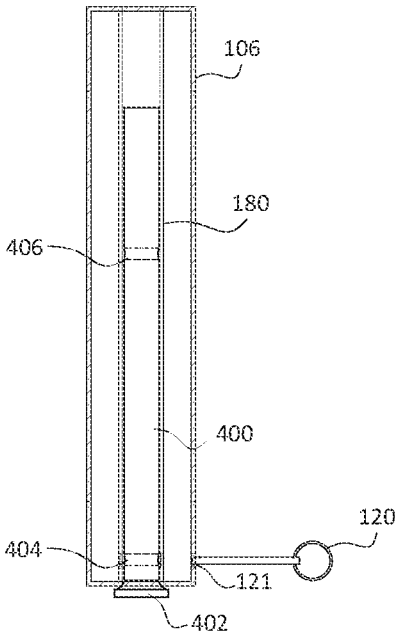
FIG. 12 illustrates a side cut-away view of a swing bed with one of the optional legs retracted.

In FIG. 12 it is shown how the pin 120 is removed from the hole 121 thereby unlocking the leg 400 allowing the leg 400 to move to a retracted position. It is also anticipated that there be an extra hole 404 in the bottom area of the leg to re-insert the pin 120 and retain the leg within the tube 180.

Figure 13:
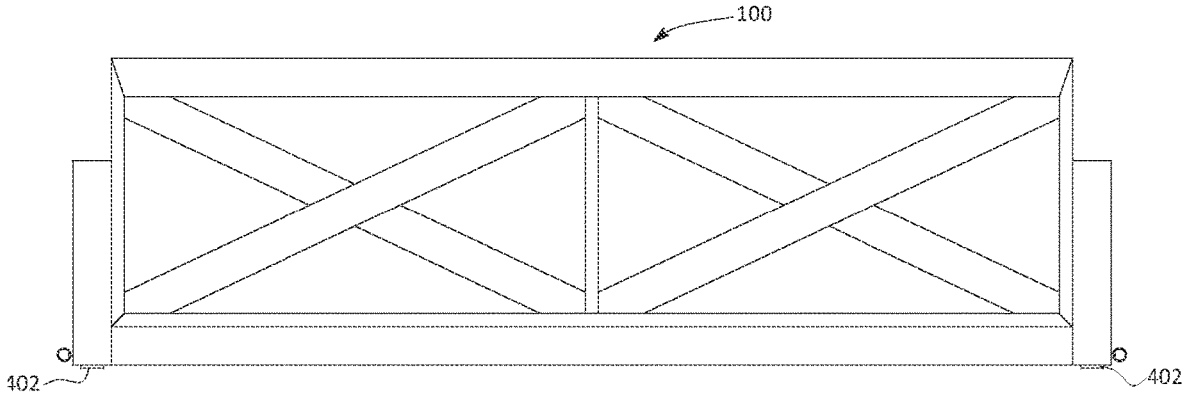
FIG. 13 illustrates an elevation view of the swing bed with optional legs in the retracted configuration.

In FIG. 13, an elevation view of the swing bed 100 with optional legs 400 is shown with the legs 400 in the retracted configuration and, therefore, only the feet 402 of the legs are visible.

In FIG. 14, an elevation view of one leg 400 is shown. In this embodiment, there are three holes 404/405/406 in each leg 400, though there is no limitation to the number of holes in each leg 400 nor any requirement to have the same number of holes in all legs 400. In this example, the leg 400 has a first hole 406 through which the pin 120 passes for full deployment of the leg 400 and having a second hole 405 through which the pin 120 passes for partial deployment of the leg 400. A third hole 404 is provided when the leg 400 is fully retracted.

Figure 15:
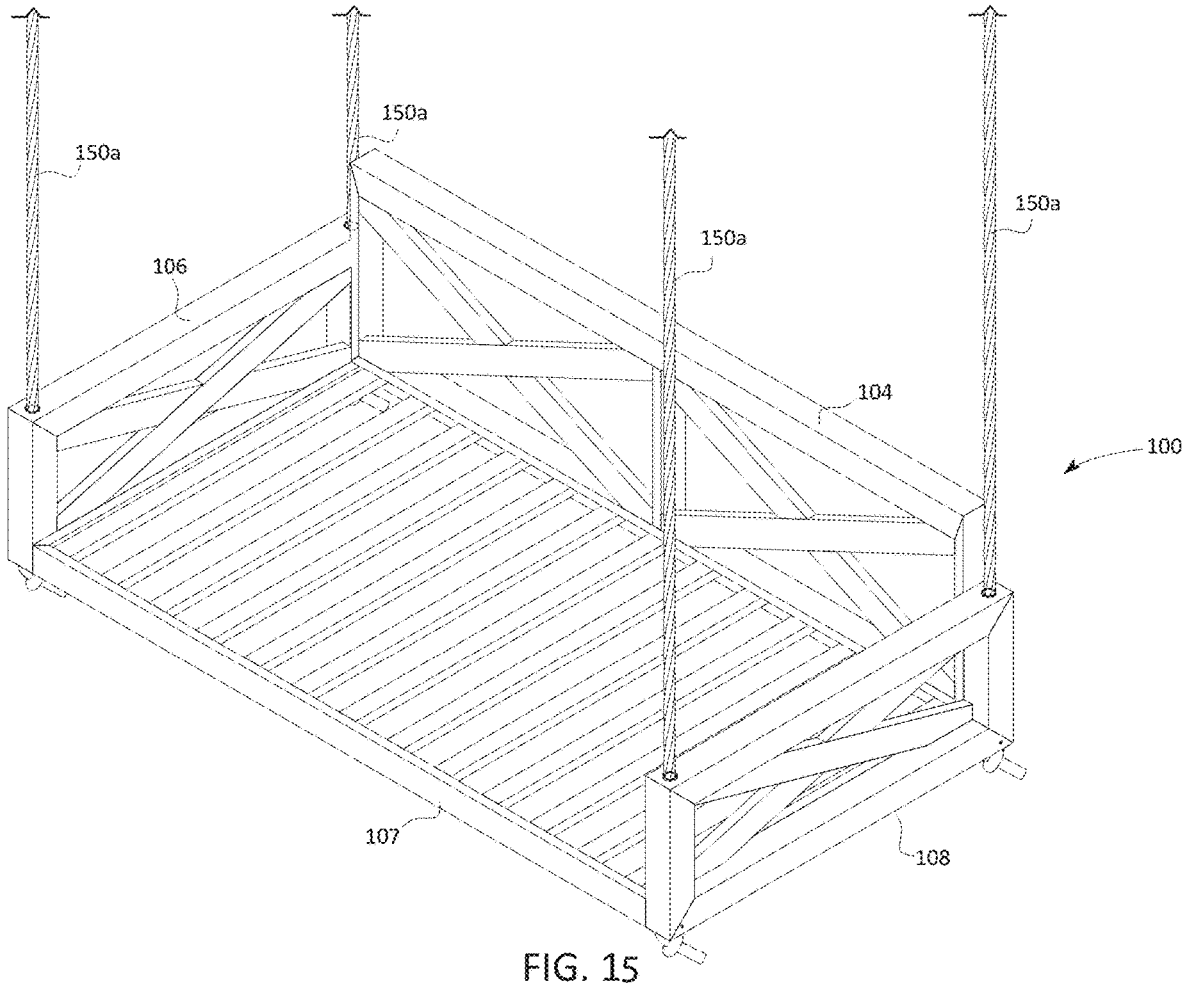
FIG. 15 illustrates a perspective view of a swing bed suspended by ropes.

Referring to FIG. 15, a perspective view of a swing bed 100 is shown suspended by ropes 150*a* as previously discussed.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A swing bed kit comprising:

a left side comprising a first set of extruded aluminum sections that are connected to each other;

a right side comprising a second set of extruded aluminum sections that are connected to each other;

a back side comprising a third set of extruded aluminum sections that are connected to each other;

a base comprising a fourth set of extruded aluminum sections that are connected to each other;

a first plurality of threaded bosses on an inside surface of the left side and on an inside surface of the right side;

a second plurality of threaded bosses on an inside surface of the back side;

a third plurality of threaded bosses on the inside surface of the left side and on the inside surface of the right side;

a first plurality of holes in the base located configured to mate with each of the first plurality of threaded bosses and the second plurality of threaded bosses;

a second plurality of holes in the back side located configured to mate with each of the third plurality of threaded bosses;

the first set of extruded aluminum sections, the second set of extruded aluminum sections, the third set of extruded aluminum sections, and the fourth set of extruded aluminum sections are hollow; and a first tube insert in the left side from a top surface of the left side to a bottom surface of the left side, a second tube insert in the left side from the top surface of the left side to the bottom surface of the left side, a third tube insert in the right side from the top surface of the right side to the bottom surface of the right side, and a fourth tube insert in the right side from the top surface of the right side to the bottom surface of the right side, each of the first tube insert, the second tube insert, the third tube insert, and the fourth tube insert configured to accept one of four suspension members.

2. The swing bed kit of claim 1, further comprising screws, at least one screw for passing through each of the first plurality of holes and each the second plurality of holes and into a respective boss of the first plurality of threaded bosses, the second plurality of threaded bosses, and the third plurality of threaded bosses for holding the left side to the base, the right side to the base, the back side to the base, the left side to the back side, and the right side to the back side.

3. The swing bed kit of claim 1, wherein a first suspension member of the four suspension members passes through the first tube insert from the top surface of the left side, a second suspension member of the four suspension members passes through the second tube insert from the top surface of the left side, a third suspension member of the four suspension members passes through the third tube insert from the top surface of the right side, and a fourth suspension member of the four suspension members passes through the fourth tube insert from the top surface of the right side.

4. The swing bed kit of claim 3, wherein the first suspension member, the second suspension member, the third suspension member, and the fourth suspension member are ropes and the ropes are tied in a knot after passing through a respective one of the first tube insert, the second tube insert, the third tube insert, and the fourth tube insert.

5. The swing bed kit of claim 3, wherein the first suspension member, the second suspension member, the third suspension member, and the fourth suspension member are chains and a first pin hole is formed going through a surface of the left side and through the first tube insert, a second pin hole is formed going through the surface of the left side and through the second tube insert, a third pin hole is formed going through a surface of the right side and through the third tube insert, and a fourth pin hole is formed going through the surface of the right side and through the fourth tube insert.

6. The swing bed kit of claim 5, wherein the first suspension member is retained in the first tube insert by a first pin inserted into the first pin hole and through the first suspension member; the second suspension member is retained in the second tube insert by a second pin inserted into the second pin hole and through the second suspension member; the third suspension member is retained in the third tube insert by a third pin inserted into the third pin hole and through the third suspension member; and the fourth suspension member is retained in the fourth tube insert by a fourth pin inserted into the fourth pin hole and through the fourth suspension member.

7. The swing bed kit of claim 1, wherein the four suspension members comprise a first leg, a second leg, a third leg, and a fourth leg, the first leg configured to be inserted into the first tube insert, the second leg configured to be inserted into the second tube insert, the third leg configured to be inserted into the third tube insert, and the fourth leg configured to be inserted into the fourth tube insert, each of the first leg, the second leg, the third leg, and the fourth leg having at least one pin hole configured to accept a pin.

8. The swing bed kit of claim 7, further comprising a first pin hole formed through a surface of the left side and through the first tube insert, a second pin hole formed through the surface of the left side and through the second tube insert, a third pin hole formed through a surface of the right side and through the third tube insert, and a fourth pin hole formed through the surface of the right side and through the fourth tube insert, and wherein the first leg is retained in the first tube insert by a first pin inserted into the first pin hole in the surface of the left side and through one of the at least one holes for accepting the pin in the first leg, the second leg is retained in the second tube insert by a second pin inserted into the second pin hole in the surface of the left side and through one of the at least one holes for accepting the pin in the second leg, the third leg is retained in the third tube insert by a third pin inserted into the third pin hole in the surface of the right side and through one of the at least one holes for accepting the pin in the third leg, and the fourth leg is retained in the fourth tube insert by a fourth pin inserted into the fourth pin hole in the surface of the right side and through one of the at least one holes for accepting the pin in the fourth leg.

9. A swing bed comprising:

a left side comprising a first set of hollow extruded aluminum sections that are connected to each other and having a first tube insert and a second tube insert interfaced between an upper surface of the left side and a lower surface of the left side;

a right side comprising a second set of hollow extruded aluminum sections that are connected to each other and having a third tube insert and a fourth tube insert interfaced between an upper surface of the right side and a lower surface of the right side;

a back side comprising a third set of hollow extruded aluminum sections that are connected to each other;

a base comprising a fourth set of hollow extruded aluminum sections that are connected to each other;

a first plurality of threaded bosses in an inside surface of the left side and an inside surface of the right side for attaching the left side to a first side of the base and attaching the right side to an opposite side of the base;

a second plurality of threaded bosses in an inside surface of the back side for attaching the back side to a back surface of the base;

a third plurality of threaded bosses in the inside surface of the left side and the inside surface of the right side for attaching the left side to a left surface of the back side and attaching the right side to a right surface of the back side;

a first plurality of holes in the base located to mate with each of the first plurality of threaded bosses and the second plurality of threaded bosses;

a second plurality of holes in the back side located to mate with each of the third plurality of threaded bosses; and screws, each screw for passing through one of the first plurality of holes and the second plurality of holes and into a respective boss of the first plurality of threaded bosses, the second plurality of threaded bosses, and the third plurality of threaded bosses for holding the left side to the base, the right side to the base, the back side to the base, the left side to the back side, and the right side to the back side; at least a first suspension member is configured to be accepted into one of the four tube inserts.

10. The swing bed of claim 9, further comprising the first suspension member passing through the first tube insert from a top surface of the left side, a second suspension member passing through the second tube insert from the top surface of the left side, a third suspension member passing through the third tube insert from a top surface of the right side, and a fourth suspension member passing through the fourth tube insert from the top surface of the right side.

11. The swing bed of claim 10, wherein the first suspension member, the second suspension member, the third suspension member, and the fourth suspension member are ropes and the ropes are tied in a knot after passing through a respective one of the first tube insert, the second tube insert, the third tube insert, and the fourth tube insert.

12. The swing bed of claim 10, wherein the first suspension member, the second suspension member, the third suspension member, and the fourth suspension member are chains and a first pin hole is formed going through a surface of the left side and through the first tube insert, a second pin hole is formed going through the surface of the left side and through the second tube insert, a third pin hole is formed going through a surface of the right side and through the third tube insert, and a fourth pin hole is formed going through the surface of the right side and through the fourth tube insert.

13. The swing bed of claim 12, wherein a first chain of the chains is retained in the first tube insert by a first pin inserted into the first pin hole and through a link of the first chain; a second chain of the chains is retained in the second tube insert by a second pin inserted into the second pin hole and through a link of the second chain; a third chain of the chains is retained in the third tube insert by a third pin inserted into the third pin hole and through a link of the third chain; and a fourth chain of the chains is retained in the fourth tube insert by a fourth pin inserted into the fourth pin hole and through a link of the fourth chain.

14. The swing bed of claim 9, further comprising:

a first pin hole formed through a surface of the left side and through the first tube insert, a second pin hole formed through the surface of the left side and through the second tube insert, a third pin hole formed through a surface of the right side and through the third tube insert, and a fourth pin hole formed through the surface of the right side and through the fourth tube insert;

the first suspension member is a first leg, a second suspension member is a second leg, a third suspension member is a third leg, and a fourth suspension member is a fourth leg; and the first leg inserted into the first tube insert and retained in the first tube insert by a first pin inserted into the first pin hole, the second leg inserted into the second tube and retained in the second tube insert by a second pin inserted into the second pin hole, the third leg inserted into the third tube insert and retained in the third tube insert by a third pin inserted into the third pin hole, and the fourth leg inserted into the fourth tube insert and retained in the fourth tube insert by a fourth pin inserted into the fourth pin hole.

15. A method of making a swing bed, the method comprising:

fabricating a left side by welding a first set of extruded aluminum sections together and inserting a first tube through a first top hole in an upper surface of the left side, through the left side, and out of a first lower hole in a lower surface of the left side and inserting a second tube through a second top hole in the upper surface of the left side, through the left side, and out of a second lower hole in the lower surface of the left side;

fabricating a right side by welding a second set of extruded aluminum sections together and inserting a third tube through a third top hole in an upper surface of the right side, through the right side, and out of a third lower hole in a lower surface of the right side and inserting a fourth tube through a fourth top hole in the upper surface of the right side, through the right side, and out of a fourth lower hole in the lower surface of the right side;

fabricating a back side by welding a third set of extruded aluminum sections together;

fabricating a base by welding a fourth set of extruded aluminum together;

forming and/or drilling a first set of holes in an inside surface of the left side and in an inside surface of the right side and press fitting a first plurality of threaded bosses into each of the first set of holes;

forming and/or drilling a second set of holes in an insides surface of the back side and press fitting a second plurality of threaded bosses into each of the second set of holes;

forming and/or drilling a third set of holes in an insides surface of the back side and press fitting a third plurality of threaded bosses into each of the third set of holes;

forming holes in the base located to mate with each of the first plurality of threaded bosses, the second plurality of threaded bosses, and the third plurality of threaded bosses; and passing each of a plurality of screws through each of the first set of holes, the second set of holes, and the third set of holes and into a respective boss of the first plurality of threaded bosses, the second plurality of threaded bosses, and the third plurality of threaded bosses for holding the left side to the base, the right side to the base, the back side to the base, the left side to the back side, and the right side to the back side; at least a first suspension member is configured to be accepted into one of the four tube inserts.

16. The method of claim 15, further comprising forming a first pin hole through a side surface of the left side and through the first tube, forming a second pin hole through the side surface of the left side and through the second tube, forming a third pin hole through a side surface of the right side and through the third tube, and forming a fourth pin hole through the side surface of the right side and through the fourth tube.

* * * * *